US006106309A

United States Patent [19]

Kakinoki

[11] Patent Number: 6,106,309

[45] Date of Patent: Aug. 22, 2000

[54] PC CARD

[75] Inventor: Wataru Kakinoki, Yokohama, Japan

[73] Assignee: Murata Manufacturing Co.,, Japan

[21] Appl. No.: 09/267,836

[22] Filed: Mar. 12, 1999

[30] Foreign Application Priority Data

Mar. 13, 1998 [JP] Japan ..... 10-082999

[51] Int. Cl.[7] ..... H01R 13/648

[52] U.S. Cl. ..... 439/92; 439/76.1

[58] Field of Search ..... 439/95, 92, 76.1, 439/946

[56] References Cited

U.S. PATENT DOCUMENTS 5,330,630 7/1994 Marsh et al. ..... 439/95
5,496,185 3/1996 Beak ..... 439/95
5,588,850 12/1996 Pan et al. ..... 439/92
5,833,473 11/1998 Betker et al. ..... 439/76.1
5,906,496 5/1999 DelPrete et al. ..... 439/95

*Primary Examiner*—Gary F. Paumen
*Attorney, Agent, or Firm*—Ostrolenk, Faber, Gerb & Soffen, LLP

[57] ABSTRACT

A PC card has a connector attaching port into which a card-side connector is fixed. Each spring protuberance of a ground electrode having a fixing frame fixed to a connecting beam of a frame extends on the upper face of the card-side connector. The projection portion of the spring protuberance projects upwardly through a protuberance accommodating hole provided in a plate of the frame. When the PC card is inserted into a 16-bit card slot, each spring protuberance is distorted downwardly through an insertion hole on the card slot side. Thus, the PC card can be attached to both the 16-bit and 32-bit card slots.

6 Claims, 7 Drawing Sheets

PC CARD

BACKGROUND OF THE INVENTION

1. Field of the Invention

The present invention relates to a PC card which is inserted into a card slot of a personal computer, for example, in order to extend the functions of the personal computer.

2. Description of the Related Art

In general, a personal computer is made up mainly of a computer body having an operation function, a memory function, and the like, a key board for inputting a signal to the computer body, a memory including a floppy disk and the like for storing memory in the computer body, and a display for indicating a program, an operational result, and the like.

Furthermore, the personal computer is provided with a card slot into which a PC card can be additionally attached in order to extend the memory contained in the computer body, add a modem, and the like. The size and shape of the PC card is specified by PC Card Standard and Standard by JEIDA(Japan Electric Industry Development Association).

As the binary unit of information content to be processed by the personal computer, a 32-bit byte has been gradually employed instead of a 16-bit byte in order to enhance the processing speed. Accordingly, there are two types of PC cards with respect to their size and shape, that is, 16-bit PC cards and 32-bit PC cards. Similarly, card slots on the personal computer side are roughly divided into two groups, that is, 16-bit and 32-bit card slots.

Furthermore, in order to reduce the consumption electric power, the driving voltage for the computer body has been changed from 5.0 V to 3.3 V. For ordinary uses, the driving voltage for 16-bit PC cards is set at 5.0 V, while that for 32-bit PC cards at 3.3 V. The driving voltage has been reduced from 5. 0 V to 3.3 V, so that it is necessary to secure the transmission or reception of a signal between the PC card and the personal computer. Therefore, the 32-bit PC card and the card slot are provided with ground electrodes having plural protuberances for tight grounding.

The respective PC cards are provided with a card key groove formed on the left-hand side thereof, viewed in the insertion direction, so that the PC cards can be prevented from being wrong inserted, turned inside out, and can be distinguished between 16-bit and 32-bit PC cards. The card-side key groove of the 16-bit PC card is so formed as to be wider than that of the 32-bit PC card.

With this card key groove, the 16-bit PC card can not only be inserted into the 16-bit card slot but also into the 32-bit card slot. On the other hand, the 32-bit PC card, though it can be inserted into the 32-bit card slot, is prevented from being inserted into the 16-bit card slot. That is, the respective protuberances of the ground electrode provided for the card slots of the 32-bit PC card prevent the 32-bit PC card from being inserted into the 16-bit card slot which has no parts for receiving the protuberance, and protects the ground electrode, the card insertion hole of the card slot, and the like.

The above-described conventional PC cards are provided with card-side key grooves formed in different sizes so that they can be distinguished between the 16-bit and 32-bit PC cards, and the 32-bit PC card can be prevented from being inserted into the 16-bit card slot, as described above.

On the other hand, PC cards which are available as both 16-bit and 32-bit cards are required. For the purpose of meeting this requirement, it is necessary to provide a PC card which can be inserted into both the 16-bit and 32-bit card slots, irrespective of the shapes and sizes of the card slots of personal computers.

SUMMARY OF THE INVENTION

Accordingly, it is an object of the present invention to solve the above-described problems and to provide a personal computer (PC) card which can be detachably fixed into both the card slots for higher-bit and lower-bit cards, irrespective of the shape and size of the card slots on the computer side.

In order to achieve the above object, according to an aspect of the present invention, there is provided a PC card including a casing composed of a frame for accommodating a circuit board, and upper and lower panels for covering the frame and having an opening as a connector attaching port provided in one side thereto, a connector formed of a rectangular member which has plural terminal pins adapted to be connected to the circuit board and plural pin holes into which terminal pins on the personal computer side are adapted to be inserted, the connector being located in the connector attaching port of the casing to be attached to the casing, and a ground electrode for connecting the ground of the circuit board to the personal computer side.

In the PC card, the frame of the casing is composed of right- and left-hand side supports separated from each other laterally extending from the front to the rear of the frame, and a connecting beam connecting the respective supports in the vicinity of the connector attaching port, and the ground electrode is composed of a fixing frame elongating along the connecting beam of the frame and engaged with the connecting beam, and plural spring protuberances each extending from the fixing frame toward one of the upper and lower flat faces of the connector and having spring properties when the PC card is inserted into a card slot.

With this configuration, when the PC card is inserted into the card slot for a lower-bit card and having no parts for receiving the ground electrode, the spring protuberances of the ground electrode contact the insertion hole of the card slot, and are distorted, directed inward of the casing. In addition, when the PC card is pulled out of the card slot, the spring protuberances, are restored. Thus, the PC card can be attached into the card slot for a higher-bit card and having a part for receiving the ground electrode. That is, the PC card can be used for both the higher-bit byte and lower-bit byte systems.

In addition, since the ground electrode has the fixing frame engaged with the connecting beam of the frame, the joining work such as soldering and the like for connection of the ground electrode to ground on the circuit board side, conducted during the assembly of the PC card, can be easily performed.

Preferably, the frame of the casing is provided with a plate which is located nearer to the connector attaching port than the connecting beam and on one of the flat faces of the connector, and is elongated between the supports, and the plate is provided with protuberance accommodating holes in which each spring protuberance of the ground electrode is to be accommodated.

With this configuration, each spring protuberance of the ground electrode is projected through the protuberance accommodating hole provided for the plate of the frame. Thus, in event that an external force is applied to the spring protuberance, the protuberance accommodating hole protects the spring protuberance from being damaged, increasing the service life of the spring protuberance.

One of the upper and lower panels constituting the casing may be provided with protuberance accommodating holes in which each spring protuberance of the ground electrode is to be accommodated.

With this configuration, each spring protuberance of the ground electrode is projected through the protuberance accommodating hole of the panel. Thus, in event that an external force is applied to the spring protuberance, the protuberance accommodating hole protects the spring protuberance from being damaged, increasing the service life of the spring protuberance.

Preferably, each spring protuberance of the ground electrode is formed as a plate spring of which the portion extending from said fixing frame is bent.

With this configuration, each spring protuberance has a plate-spring structure. When the PC card is inserted into the card slot for a lower-bit card, the spring protuberance of the ground electrode gets into contact with the insertion hole of the card slot, so that the spring protuberance is distorted. When the PC card is pulled out of the card slot, the spring protuberance is restored, owing to the plate-spring structure.

Preferably, at least a part of each spring protuberance of the ground electrode which projects from the casing is so formed as to have an arc-shaped cross-section.

With this configuration, when the spring protuberance is displaced through the protuberance accommodating hole, the sides of the spring protuberance are prevented from being caught by the protuberance accommodating hole.

DESCRIPTION OF THE PREFERRED EMBODIMENT

Figure 1:
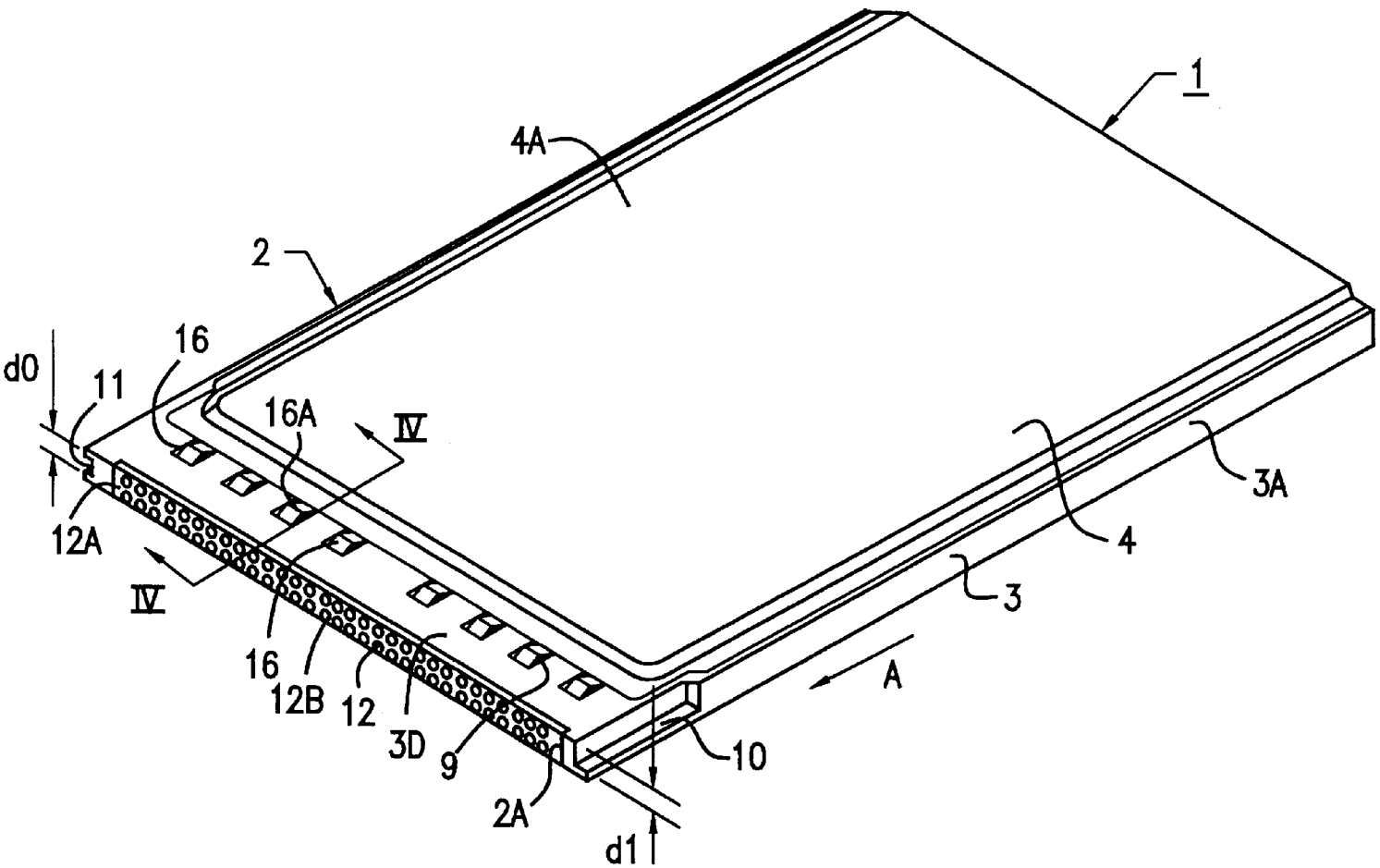
FIG. 1 is a perspective view of a PC card according to a first embodiment of the present invention.

A preferred embodiment will be now described with reference to FIGS. 1 through 12. First, a first embodiment of the present invention will be described below with reference to FIGS. 1 through 11.

A PC card 1 of the instant embodiment is adapted for both the 16-bit and 32-bit slots. A casing 2 constitutes the contour of the PC card 1 and is formed in a thin plate shape. The casing 2 is composed of a frame 3 which is thin and has openings in the upper, lower sides, respectively, an upper panel 4 for covering the upper opening of the frame 3 and having a rectangular bulgy portion 4A, and a lower panel 5 for covering the lower opening of the frame 3 and having a bulgy portion 5A rectangular as well to define a space 6 for accommodating a board therein.

A circuit board 7 is accommodated in the board-accommodating space 6 of the casing 2. A circuit is so configured and set on the board that an electronic component 8 mounted on the circuit board 7 is adaptable for processing of not only 32-bit bytes at a driving voltage of 3.3 V but also 16-bit bytes at a driving voltage of 5.0 V.

Circuits adaptable for processing of 32-bit bytes at a driving voltage of 3.3 V and 16-bit bytes at a driving voltage of 5.0 V can be switched with a change-over switch (not shown) and the like, depending on the personal computer to which the PC card is attached.

One side of the casing 2 is open to form a connector attaching port 2A. A card-side connector 12 is fixed into the connector attaching port 2A. An arrow A of FIG. 1 indicates the insertion direction of the PC card 1.

Figure 2:
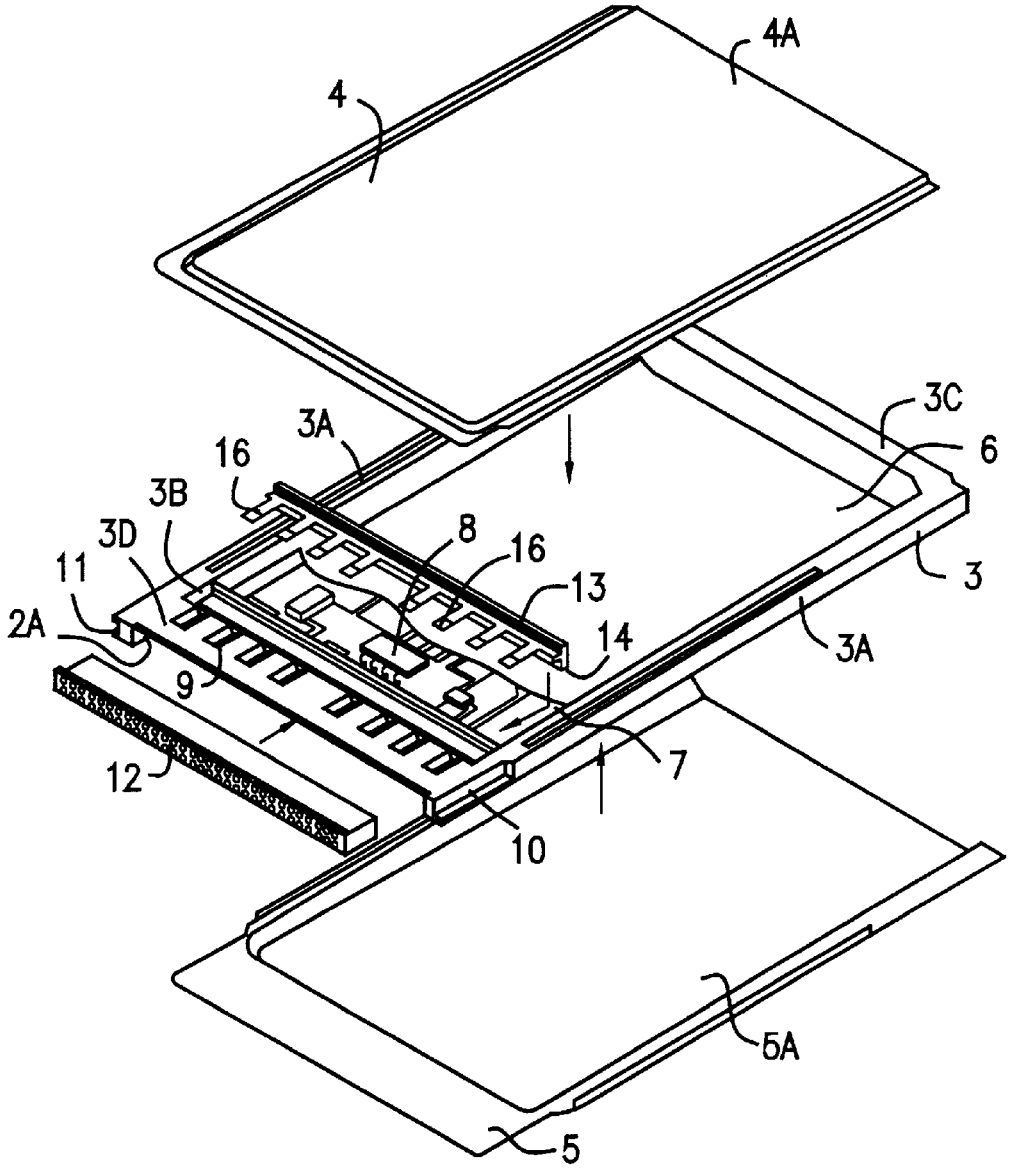
FIG. 2 is an exploded perspective view showing a frame, an upper panel, a lower panel, a card-side connector, and a ground electrode which constitute the PC card of the first embodiment.
Figure 3:
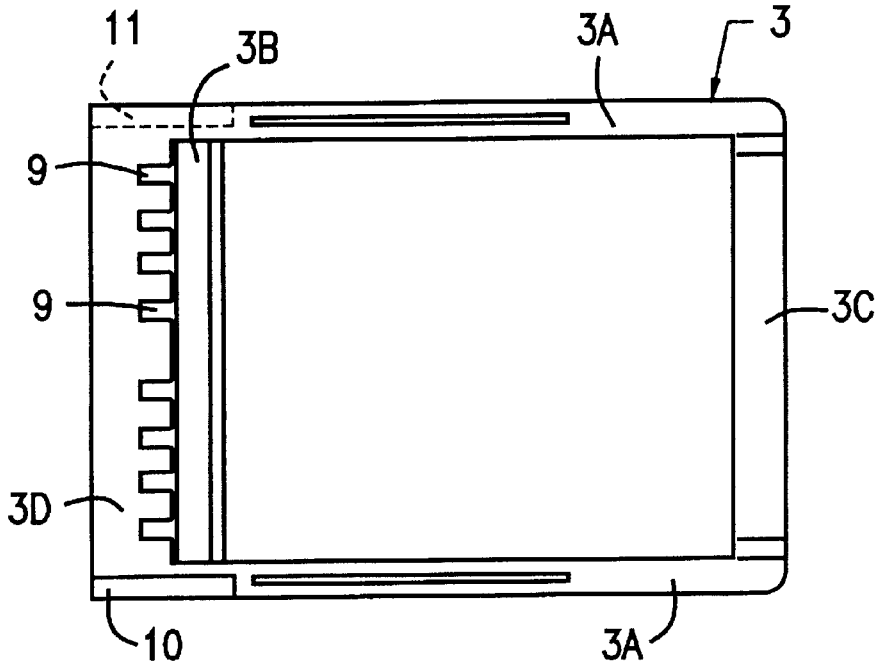
FIG. 3 is a plane view of the frame employed in the first embodiment.

The frame 3 is formed with a resin material in a rectangular shape, as shown in FIGS. 2 and 3. The frame 3 is composed of right- and left-hand side supports 3A laterally separated from each other extending between the front and the rear of the frame 3, a connecting beam 3B having a prism shape and connecting the supports 3A in the vicinity of the connector attaching port 2A, a connecting portion 3C connecting the supports 3A on the rear side, and a plate 3D positioned nearer to the connector attaching port 2A than the connecting beam 3B and on the upper face of the card-side connector 12 and elongating between the supports 3A. Plural (for example, eight holes) protuberance-accommodating holes 9 are formed in the plate 3D, as described below. The upper face of the card-side connector 12 is in contact with the lower side of the plate 3D (see FIG. 4).

The plural protuberance accommodating holes 9 are formed in the plate 3D of the frame 3 in a rectangular shape. The spring protuberances 16 of the ground electrode 13 are projected through the protuberance-accommodating holes 9, respectively.

A card-side key groove 10 is formed on the left-hand side of the PC card 1, viewed in the PC card insertion-direction. The card-side key groove 10 is provided on the side wall, present on the left-hand side thereof viewed in the insertion direction, of the frame 3 of the casing 2, in the vicinity of the connector attaching port 2A, and is formed by cutting the upper portion of the frame 3. The formed card-side key groove 10 has the groove width d1 which is equal to that of the card-side key groove of the 16-bit PC card specified by the Standard.

A guide groove 11 is formed on the right-hand side, viewed in the insertion direction, of the PC card 1. The guide groove 11 is positioned on the right-hand side of the frame 3 viewed in the insertion direction, in the vicinity of the connector attaching port 2A of the frame of the casing 11, and is formed by grooving the side wall of the frame. The formed guide groove 11 has a groove width d0 which is specified by the Standard.

A long card-side connector 12 provided in the connector attaching port 2A of the casing 2 is composed of a rectangular member 12A formed with an insulation resin material in a long shape, a total of 68 pin holes 12B arranged in two rows of 34 pin holes and extending from the front to the back of the rectangular member 12A, and terminal pins 12C of which the base ends are positioned in the inner parts of the pin holes 12B and the tips project from the back of the rectangular member 12A for connection to the circuit board 7, respectively.

Figure 4:
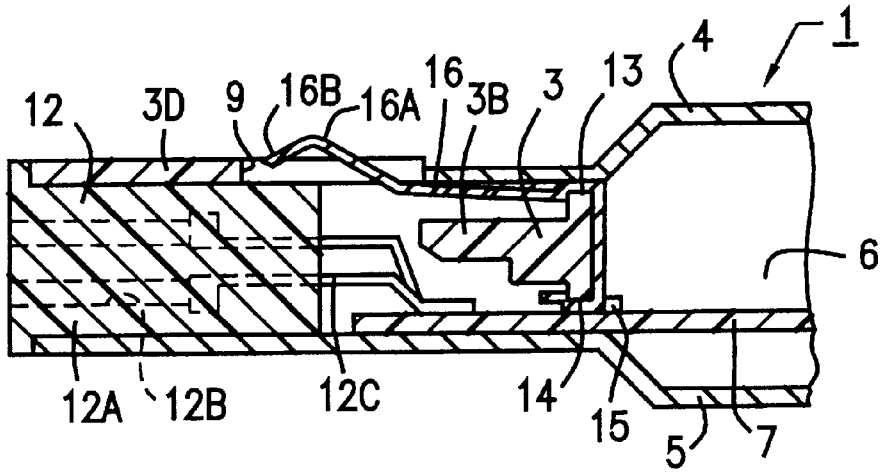
FIG. 4 is a partial longitudinal sectional illustration of the insertion side of the PC card, taken in the direction of an arrow IV—IV of FIG. 1.
Figure 5:
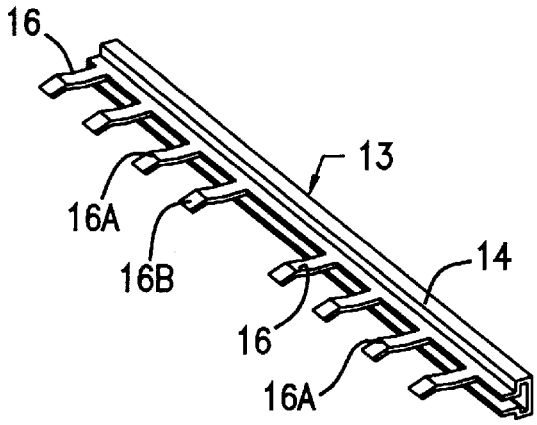
FIG. 5 is a perspective view of a ground electrode employed in the PC card of the first embodiment.
Figure 7:
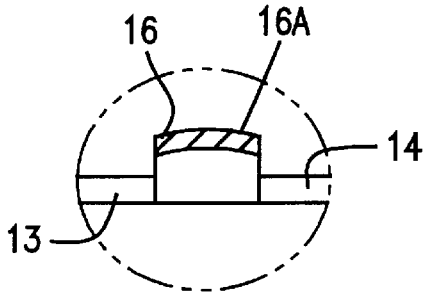
FIG. 7 is a longitudinal sectional view of the spring protuberance, taken in the direction of an arrow VII—VII of FIG. 6.

As shown in FIGS. 4 and 7, a ground electrode 13 formed with an electro-conductive metal sheet is composed of a fixing frame 14 extending along the connecting beam 3B of the frame 3 and so formed as to have a U-shaped cross section with which the connecting beam 3B is engaged, plural (for example, eight terminals) ground terminals 15 each extending from the fixing frame 14 to ground on the circuit board 7 side (see FIG. 4), and spring protuberances 16 each extending from the fixing frame 14 toward the upper face of the card-side connector 12. Each spring protuberance 16 is so formed that the tip side of its portion extending from the fixing frame 14 is bent substantially into a chevron-shape, whereby the bent portion becomes a protuberant portion 16A and the tip 16B is a free end, extending on the upper face of the card-side connector 12. When the spring protuberance 16 is pressed by an external force from the upper side thereof, the tip 16B of the spring protuberance 16 is placed and supported on the upper face of the card-side connector 12 (see FIG. 4).

Figure 6:
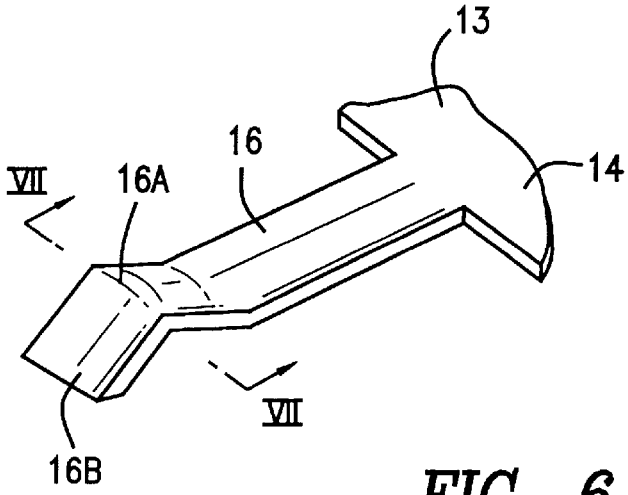
FIG. 6 is an enlarged perspective view of the spring protuberance of the ground electrode.

As shown in FIGS. 6 and 7, each spring protuberance 16 is so formed as to have an arc-shaped cross section in the projecting portion 16A. Therefore, flashes and the like, generated when the spring protuberance 16 are formed, can be directed inwardly of the spring protuberance 16. Therefore, the edges of the projecting portion 16A and its neighborhood, projected through the protuberance-accommodating hole 9, of the spring protuberance 16 is prevented from being caught in the protuberance-accommodating holes 9.

It is not needed to provide the ground electrode 15. The fixing frame 14 may be soldered directly on the ground on the circuit board 7 side.

The PC card 1 of the instant embodiment has the above-described configuration. Hereinafter, a 32-bit card slot, conventionally used, will be described with reference to FIGS. 8 and 10.

A 32-bit card slot 21 is composed mainly of a housing 22 having a card insertion hole 22A which has a size larger to some degree than the outside size of the PC card 1, and a slot-side connector 23 provided in the inner part of the card insertion hole 22A of the housing 22.

The slot-side connector 23 is composed of a rectangular member 23A formed with a resin material in a long shape and having a connector insertion hole 23B into which the card-side connector 12 is inserted through the card insertion hole 22A, and a total of 68 connecting pins 23C positioned in the inner part of the connector insertion hole 23B formed in the rectangular member 23A, projecting therefrom, and arranged in two rows of 34 pins. When the card-side connector 12 is inserted into the connector insertion hole 23B of the slot-side connector 23, the connecting pins 23C get into connection to the terminal pins 12C positioned in the inner parts of the pin holes 12B, respectively.

Figure 10:
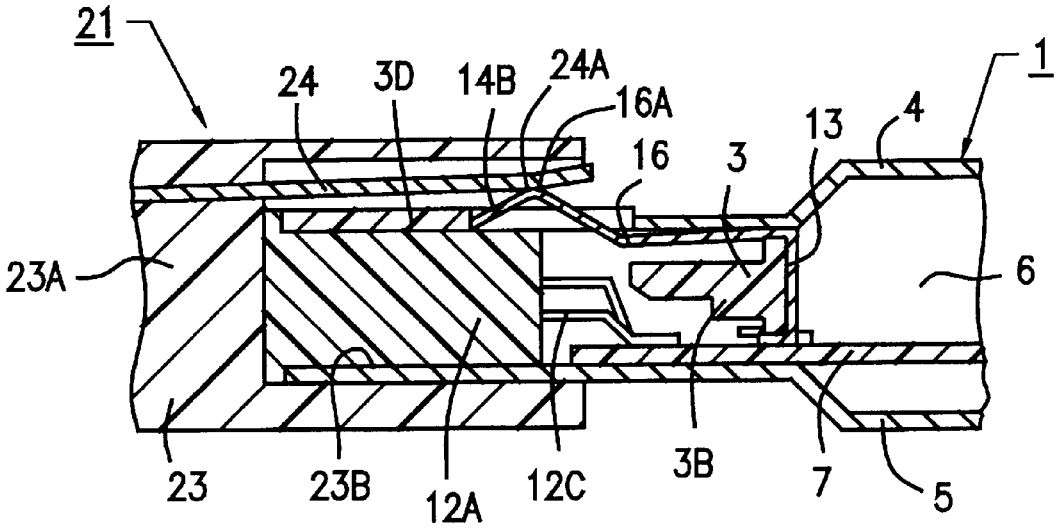
FIG. 10 is a partial longitudinal sectional view illustrating the state that the PC card of the embodiment is inserted into the slot-side connector of the 32-bit PC card slot.

A receiving ground electrode 24 formed in the upper part of the connector insertion hole 23B, as shown in FIG. 10, comprises plural (for example, eight pieces) contact pieces 24A which are directed downward so as to present spring properties. Each contact piece 24A of the receiving ground electrode 24, when the 32-bit PC card 1 is inserted into the card insertion hole 22A, gets into contact with each spring protuberance 16 of the ground electrode 13.

Figure 8:
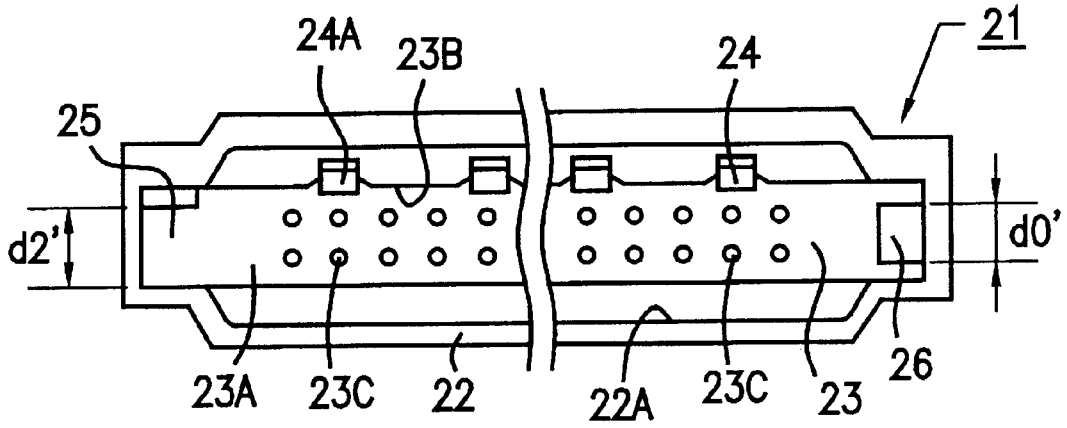
FIG. 8 is a front view of a 32-bit PC card slot, taken in the insertion direction.

A slot-side key groove 25 is formed on the left-hand side viewed in the insertion direction of the PC card. As shown in FIG. 8, the slot-side key groove 25 is provided in the vicinity of the connector insertion hole 23B of the rectangular member 23A of the slot-side connector 23, positioned on the left-hand side viewed in the insertion direction, and is formed by grooving the side wall of the rectangular member 23A in the insertion direction. The formed slot-side key groove 25 has a wide groove width d2' which corresponds to that of the card-side key groove of the 32-bit PC card specified by the Standard.

A guide protuberance 26 is formed on the right-hand side viewed in the PC card insertion direction, and as shown in FIG. 8, is provided in the vicinity of the connector insertion hole 23B of the rectangular member 23A of the slot-side connector 23 and, positioned on the right-hand side viewed in the insertion direction, and is formed by grooving the side wall of the rectangular member 23A in the insertion direction. The guide protuberance 26 has a thickness d0' which is thinner to some degree than the groove width d0 of the guide groove 11 of the PC card 1.

Figure 9:
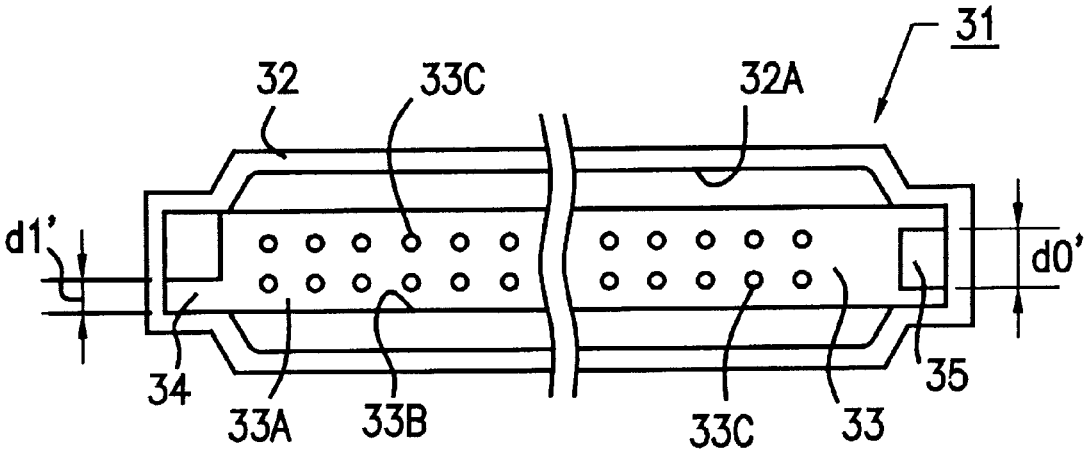
FIG. 9 is a front view of a 16-bit PC card slot, taken in the insertion direction.

The 16-bit card slot, conventionally used, will be described below with reference to FIG. 9.

A 16-bit card slot 31 is composed mainly of a housing 32 having a card insertion hole 32A which has a size larger to some degree than the outside size of the PC card 1, and a slot-side connector 33 provided in the inner part of the card insertion hole 32A of the housing 32.

The slot-side connector 33 is composed of a rectangular member 33A formed with a resin material in a long shape, and having a connector insertion hole 33B into which the card-side connector 12 is inserted through the card insertion hole 32A, and a total of 68 connecting pins 33C positioned in the inner part of the connector insertion hole 33B, projecting therefrom, and arranged in two rows of 34 pins. When the card-side connector 12 of the PC card 1 is inserted into the connector insertion hole 33B of the slot-side connector 33, the tips of the connecting pins 33C get connect with to the terminal pins 12C positioned in the inner parts of the pin holes 12B, respectively.

A slot-side key groove 34 is formed on the left-hand side viewed in the insertion direction of the PC card. More particularly, the slot-side key groove 34 is provided in the vicinity of the connector insertion hole 33B of the rectangular member 33A of the slot-side connector 33, positioned on the left-hand side viewed in the insertion direction, and is formed by grooving the side wall of the rectangular member 33A along the insertion direction. The formed slot-side key groove 34 has a wide groove width d1' which corresponds to that of the card-side key groove of the 16-bit PC card specified by the Standard.

A guide protuberance 35 is formed on the right-hand side viewed in the PC card insertion direction, and is provided in the vicinity of the connector insertion hole 33B of the rectangular member 33A of the slot-side connector 33, positioned on the right-hand side viewed in the insertion direction, and formed by grooving the side wall of the rectangular member 33A in the insertion direction. The guide protuberance 35 has a thickness d0' which is thinner to some degree than the groove width d0 of the guide groove 11 of the PC card 1.

Hereinafter, the case in which the PC card 1, having the above-described configuration, is inserted into the above-described 32-bit card slot 21 will be described with reference to FIG. 10. When the card-side connector 12 is inserted into the slot-side connector 23, the card-side key groove 10 is guided by the slot-side key groove 25, and the guide groove 11 by the guide protuberance 26.

Each spring protuberance 16 formed in the ground electrode 13 contacts the contact piece 24A of the receiving ground electrode 24 on the 32-bit card slot side 21. In addition, the spring protuberance 16, given spring properties, contacts the contact piece 24A, to a high electric contact degree, further contributed by the spring force of the contact piece 24A.

Figure 11:
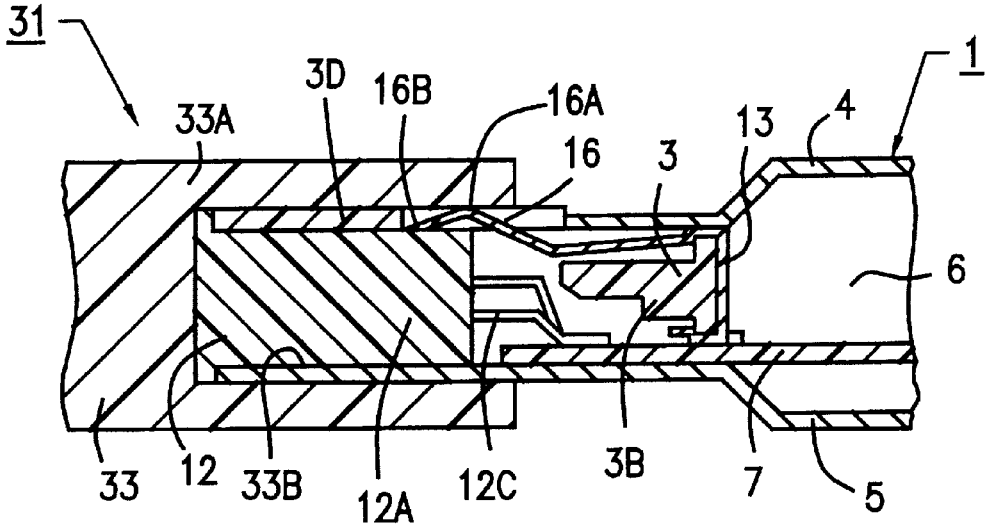
FIG. 11 is a partial longitudinal sectional view illustrating the state that the PC card of the embodiment is inserted into the slot-side connector of the 16-bit PC card slot.

Hereinafter, the case that the PC card 1 is inserted into the 16-bit card slot 31 will be described with reference to FIG. 11. When the PC card 1 is inserted into the slot-side connector 33 of the 16-bit card slot 31, the card-side key groove 10 is guided by the slot-side key groove 34, and the guide groove 11 by the guide protuberance 35.

More particularly, when the card-side connector 12 of the PC card 1 is inserted into the connector insertion hole 33B of the slot-side connector 33, the projecting portion 16A of each spring protuberance 16 formed in the ground electrode 13 is pressed by the connector insertion hole 33B, and the tip 16B of the spring protuberance 16 is received and supported on the upper face of the card-side connector 12. Accordingly, the PC card 1 can be attached, without damaging the 16-bit card slot 31.

In addition, the PC card 1 can be attached into the 16-bit card slot 31 without damaging the card insertion hole 32A of the 16-bit card slot 31, the connector insertion hole 33B of the slot-side connector 33, and the like. Furthermore, after the PC card 1 is pulled out, each spring protuberance 16 is restored with its spring force. Therefore, the PC card can be inserted into the ordinary 32-bit card slot 21 as described above.

As a result, the PC card 1 can be detachably inserted into both of the 32-bit and 16-bit card slots 21 and 31. That is, the PC card 1 is available for both 32-bit byte and 16-bit byte systems. Thus, the PC card 1 has a wider use range.

The projecting portion 16A of each spring protuberance 16 is projected upwardly through the protuberanceaccommodating hole 9 of the casing 2, and the tip 16B is extended on the card-side connector 12. Accordingly, when the PC card 1 is inserted into the 16-bit card-side slot 31, the tip 16B of the spring protuberance 16 is received and supported on the upper face of the card-side connector 12, so that the spring protuberance 16 is prevented from contacting the terminal pin 12C of the card-side connector 12, enhancing the reliability of the PC card 1.

When the PC card is pulled out of the 16-bit card-side slot 31, each spring protuberance 16 is restored with its spring force. In addition, the projection portion 16A of each spring protuberance 16 is so formed as to have an arc-shaped cross section as shown in FIG. 7, which prevents the spring protuberance 16 from being caught in the protuberance-accommodating holes 9 when it is displaced.

Furthermore, since each protuberance-accommodating hole 9 surrounds the spring protuberance 16, the spring protuberance 16 is protected from being bent and damaged in event that an external force is applied to the spring protuberance 16 in the lateral direction. This is effective in increasing the service life of each spring protuberance 16.

In addition, for assemblage of the PC card 1, the ground electrode 13 is built in while the fixing frame 14 is engaged with the connecting beam 3B of the frame 3. Therefore, the work of soldering each ground terminal 15 of the ground electrode 13 onto the circuit board 7 can be simplified, improving the working efficiency of the assembly.

Figure 12:
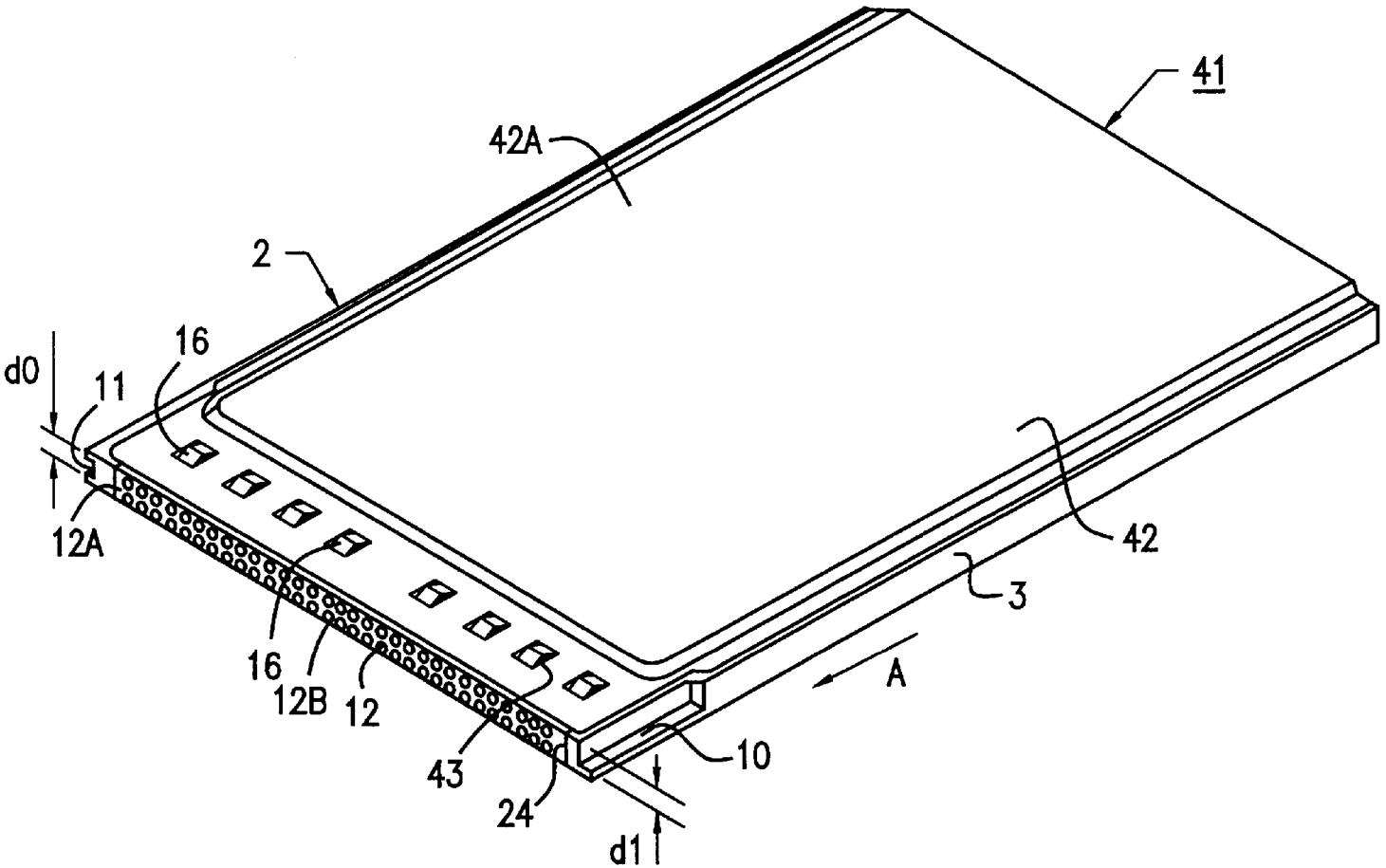
FIG. 12 is a perspective view of a PC card according to a second embodiment of the present invention.

Hereinafter, a second embodiment of the present invention will be described with reference to FIG. 12. In the instant embodiment, the same components as in the first embodiment are designated by the same reference numerals, and the description of the components is omitted.

The PC card 41 of the instant embodiment is characteristic in that the upper panel 42 constituting the casing 2 is provided with protuberance accommodating holes 43 in which each spring protuberance 16 of the ground electrode 13 is accommodated.

According to the PC card 41 of the instant embodiment, operation and working effect similar to those of the PC card 1 of the above-described first embodiment can be obtained. The PC card 41 can be attached into both the 16-bit and 32-bit card slots.

In the above-described embodiments, the spring protuberance 16 is so formed as to have an arc-shaped cross section. However, the cross-section of the spring protuberance 16 may be bent by bending the sides of the spring protuberance inwardly.

In the above-described embodiments, the PC card is described by way of 32-bit and 16-bit PC cards specified by the Standard. However, the present invention may be applied for the case that 64-bit and 128-bit PC cards specified by the Standard are used with 16-bit card connectors, and so forth, and is not restricted on the specifications employed in the above embodiments.

There are available personal computers provided with special card slots in which the driving voltage is 3.3 V and applicable for 16-bit cards. According to the present invention, similar advantageous effects can be obtained for such personal computers.

As described above, according to the present invention, the frame of the casing is composed of the right-hand and left-hand supports and the connecting beam connecting the respective supports in the vicinity of the connector attaching port, the ground electrode is composed of the fixing frame elongating along the connecting beam of the frame and engaged with the connecting beam, and the plural spring protuberances each extending from the fixing frame toward one of the upper and lower flat faces of the connector. Therefore, for example, when the PC card is inserted into the lower-bit card slot having no parts for receiving the ground electrode, the spring protuberances are displaced toward the casing side, so that the PC card can be attached into the card slot.

In addition, when the PC card is pulled out of the card slot, the spring protuberances are restored. Thus, the PC card can be attached into the higher-bit card slot having a part for receiving the ground electrode and also the lower-bit card slot having no parts for receiving the ground electrode. The PC card has wider use fields.

Furthermore, since the ground electrode is attached in such that the fixing frame is engaged with the connecting beam of the frame, the joining work such as soldering and the like for connection of the ground electrode to ground on the circuit board side, conducted when the PC card is assembled, can be easily performed. The working efficiency of the assembly can be enhanced.

Preferably, the frame of the casing is provided with the plate which is located nearer to the connector attaching port than the connecting beam and on one of the flat faces of the connector, and is elongated between the supports, and the plate is provided with protuberance accommodating holes in which each spring protuberance of the ground electrode is to be accommodate. In this case, each spring protuberance of the ground electrode can be projected through the protuberance accommodating hole provided for the plate of the frame. Thus, in event that an external force is applied to the spring protuberance, the protuberance accommodating hole protects the spring protuberance from being damaged, increasing the service life of the spring protuberance.

One of the upper and lower panels constituting the casing may be provided with protuberance accommodating holes in which each spring protuberance of the ground electrode is to be accommodated. In this case, each spring protuberance of the ground electrode can be projected through the protuberance accommodating hole of the panel. Thus, in event that an external force is applied to the spring protuberance, the protuberance accommodating hole protects the spring protuberance from being damaged, increasing the service life of the spring protuberance and enhancing the reliability.

Preferably, each spring protuberance of the ground electrode is formed as a plate spring of which the portion thereof extending from the fixing frame is bent. In this case, when the PC card is inserted into the lower-bit card slot, the spring protuberance of the ground electrode gets into contact with the insertion hole of the card slot. Thus, the PC card can be inserted into the card slot such that the spring protuberance is distorted.

Preferably, at least a part of each spring protuberance of the ground electrode which is projected from the casing is so formed as to have an arc-shaped cross-section. In this case, when the spring protuberance is displaced through the protuberance accommodating hole, the sides of the spring protuberance are prevented from being caught in the protuberance accommodating hole. This increases the service life of the spring protuberance.

What is claimed is:

1. A PC card comprising a casing composed of a frame for accommodating a circuit board, and upper and lower panels for covering said frame and having an opening as a connector attaching port provided in one side of the casing, a connector formed of a rectangular member which has plural terminal pins adapted to be connected to said circuit board and plural pin holes into which terminal pins are adapted to be inserted, said connector being located in the connector attaching port of said casing to be attached thereto, and a ground electrode for connecting a ground of said circuit board, wherein the frame of said casing is composed of left-hand side supports separated from each other laterally and extending from the front to the rear of said frame, and a connecting beam connecting the respective supports in the vicinity of the connector attaching port, and said ground electrode is composed of a fixing frame extending along the connecting beam of said frame and engaged with said connecting beam, and plural spring protuberances each extending from the fixing frame toward one of upper and lower flat faces of said connector and having spring properties.

2. A PC card according to claim 1, wherein the frame of said casing is provided with a plate which is located nearer to said connector attaching port than said connecting beam and on one of the flat faces of said connector and extends between said supports, and said plate is provided with protuberance accommodating holes in which each spring protuberance of said ground electrode is accommodated.

3. A PC card according to claim 1, wherein one of the upper and lower panels constituting said casing is provided with protuberance accommodating holes in which each spring protuberance of said ground electrode is to be accommodated.

4. A PC card according to any one of claims 1, 2, and 3, wherein each spring protuberance of said ground electrode is formed as a plate spring of which the portion extending from said fixing frame is bent.

5. A PC card according to any one of claims 1, 2, and 3, wherein at least a part of each spring protuberance of said ground electrode which projects from said casing is so formed as to have an arc-shaped cross-section.

6. A PC card according to claim 4, wherein at least a part of each spring protuberance of said ground electrode which projects from said casing is so formed as to have an arc-shaped cross-section.

* * * * *